US007286641B2

(12) United States Patent
Brendler et al.

(10) Patent No.: US 7,286,641 B2
(45) Date of Patent: Oct. 23, 2007

(54) METHOD AND DEVICE FOR EXPOSING X-RAY IMAGES

(75) Inventors: Joachim Brendler, Hamburg (DE); Reinhard Steiner, Hamburg (DE)

(73) Assignee: Koninklijke Philips Electronics, N.V., Eindhoven (NL)

( * ) Notice: Subject to any disclaimer, the term of this patent is extended or adjusted under 35 U.S.C. 154(b) by 106 days.

(21) Appl. No.: 10/556,737

(22) PCT Filed: May 5, 2004

(86) PCT No.: PCT/IB2004/050597

§ 371 (c)(1),
(2), (4) Date: Nov. 14, 2005

(87) PCT Pub. No.: WO2004/103034

PCT Pub. Date: Nov. 25, 2004

(65) Prior Publication Data

US 2007/0003015 A1 Jan. 4, 2007

(30) Foreign Application Priority Data

May 16, 2003 (EP) ..... 03101375

(51) Int. Cl.
*H05G 1/34* (2006.01)

(52) U.S. Cl. ..... 378/110; 378/108

(58) Field of Classification Search ..... 378/108–115, 378/96, 118

See application file for complete search history.

(56) References Cited

U.S. PATENT DOCUMENTS

| | | | | |
|---|---|---|---|---|
| 4,763,343 | A | 8/1988 | Yanaki | 378/110 |
| 4,956,857 | A | 9/1990 | Kurosaki | 378/110 |
| 5,694,449 | A | 12/1997 | Aragones | 378/115 |
| RE35,848 | E | 7/1998 | Tanaka | 378/16 |
| 5,949,811 | A * | 9/1999 | Baba et al. | 378/108 |
| 6,151,383 | A | 11/2000 | Xue et al. | 378/108 |
| 6,222,907 | B1 | 4/2001 | Gordon et al. | 378/116 |
| 6,233,310 | B1 | 5/2001 | Relihan et al. | 378/108 |
| 6,570,958 | B2 | 5/2003 | Brendler | 378/113 |
| 2002/0085673 | A1 | 7/2002 | Rinaldi et al. | 378/108 |
| 2002/0191741 | A1 | 12/2002 | Brendler et al. | 378/96 |
| 2005/0078795 | A1 * | 4/2005 | Kawabuchi | 378/111 |

FOREIGN PATENT DOCUMENTS

| | | |
|---|---|---|
| DE | 1 946 036 | 3/1971 |
| DE | 101 22 041 A1 | 11/2002 |
| DE | 101 36 947 A1 | 2/2003 |
| EP | 0 276 170 A2 | 7/1988 |
| EP | 0 346 530 A1 | 12/1989 |
| WO | WO 00/67006 | 11/2000 |

* cited by examiner

*Primary Examiner*—Hoon Song

(57) ABSTRACT

The invention relates to a method of controlling the exposure of an X-ray image. Starting values for the tube current, the tube voltage and the exposure duration are hereby set on the X-ray tube (10). Following the start of the exposure, the resultant dose rate is measured by a sensor (30, 31) and made available to a control system (100, 200, 300). In order to achieve a predetermined dose for the X-ray image, the control system adjusts the following variables in succession: the tube current within a current range; if applicable, the exposure duration within a time slot; the tube voltage within a voltage range; the exposure duration within the time slot. A rapid controlling of the tube current is enabled, preferably by the pulse-width modulation of the counter-voltage at the control grid of the X-ray tube.

9 Claims, 2 Drawing Sheets

| | I | U | t |
|---|---|---|---|
| I | $I_{min}$ | $U_{min}$ | $\Delta: [0, T_{min}]$ |
| II | $I_{min}$ | $\Delta: [U_{min}, U_0]$ | $T_{min}$ |
| III | $I_{min}$ | $U_0$ | $\Delta: [T_{min}, t_0]$ |
| IV | $I_0$ | $U_0$ | $t_0$ |
| V | $\Delta: [I_{min}, I_{max}]$ | $U_0$ | $t_0$ |
| VI | $I_{max}$ | $U_0$ | $\Delta: [t_0, T_{max}]$ |
| VII | $I_{max}$ | $\Delta: [U_0, U_{max}]$ | $T_{max}$ |
| VIII | $I_{max}$ | $U_{max}$ | $\Delta: t > T_{max}$ |

METHOD AND DEVICE FOR EXPOSING X-RAY IMAGES

The invention relates to an X-ray source with an X-ray tube and with a control system to control the exposure of X-ray images. It further relates to an X-ray system with an X-ray source of this kind and a method of controlling the exposure of X-ray images.

For the X-ray investigation of the human body and its organs, numerous adjustments have to be undertaken on the X-ray generator of an X-ray source in order to achieve an optimum image of the area under investigation. This is due to the fact that the density of the various organs or areas of the body varies greatly per se and differs even in different people depending on their height and weight. Furthermore, in order to ensure that the investigation is safe for the patient, with a radiation loading that is as small as possible, statutory regulations have been passed in almost all countries, on the basis of which certain parameters may be adjusted or varied only within certain limits.

Attention has to be paid, in particular, to the following mutually dependent parameters, which must be synchronized with one another and which affect the exposed image in different ways: For one thing, the dose rate of the X-ray tube (i.e. essentially the exposure voltage in kV) determines the contrast and the contrast range of the replicated objects. On the other hand, the radiation dose primarily determines the signal-to-noise ratio of the image, whilst, in order to optimize the image definition, the exposure duration (time to produce the image) must not exceed a certain maximum value, especially in the case of moving objects. In order to synchronize or select these parameters, the density (X-ray absorption) of the object to be represented, i.e. generally the mass of the patient, must also be taken into account. Finally, various statutory provisions or guidelines also often apply to the radiation dose hitting the radiation detector.

In this connection, a method of automatically regulating the exposure of X-ray images is known from DE 101 22 041 A1. Starting from predetermined starting values for the exposure duration, the tube voltage and the tube current at the start of the X-ray exposure, the dose rate arising (i.e. the absorption of the investigation object) is measured via a sensor. The measured value is compared with a nominal value which, adhering to the exposure duration set, would yield an X-ray image with an optimum radiation dose. According to the error of the measured value from the nominal value, the exposure duration is initially adjusted within a time slot. If this adjustment of the exposure time is insufficient, the next step is to amend the tube voltage within predetermined limits. If this adjustment is also insufficient, the exposure time is altered once again until the desired optimum radiation dose or the predetermined acceptability limits are reached. The method described leads to good results, especially when generating dynamic X-ray images (image sequences). However, it is problematic that, in many exposure situations, an adjustment of the tube voltage has to take place, leading to varying image quality.

Against this background, it is an object of the present invention to provide means for the automatic exposure control of X-ray images, with which an image quality as high and as constant as possible is achieved and with which adherence for as long as possible to predetermined target variables in respect of exposure duration and tube voltage is possible.

This object is achieved by an X-ray source with the features as claimed in claim 1, by an X-ray system with the features as claimed in claim 9 and by a method with the features as claimed in claim 10. Advantageous embodiments are contained in the dependent claims.

The X-ray source in accordance with the invention essentially comprises three components:

- an X-ray tube for generating X-rays, wherein the spectrum and intensity of the X-radiation depend on the applied tube voltage and the tube current. The X-ray tube is typically equipped with an anode against which electrons from a heating filament, accelerated by the tube voltage, impact, generating X-radiation. The current intensity of the electrons hereby corresponds to the tube current.
- a measuring unit for detecting, in the current object under investigation (e.g. a patient), the X-ray absorption resulting from the activity of the X-ray source. The measuring unit may be, in particular, a dose sensor or dose-rate sensor, which, in relation to the X-radiation, is arranged behind the object under investigation, and which measures the radiation penetrating the object under investigation. The measuring unit hereby supplies information as to the actual X-ray absorption of the object under investigation.
- a control system, coupled to the X-ray tube and the measuring unit, to control the tube current, the tube voltage and the exposure duration of the X-ray tube. The control system is set up to perform the following steps:

a) To preset given start values for the tube voltage and tube current of the X-ray tube; these start values are generally specified by the user in accordance with the particular exposure situation, e.g. depending on the patient (child/adult, body weight etc.), on the organ under investigation or on the desired image quality. Ideally, an optimum X-ray image would be generated with the said start values and a specified exposure duration.

b) To start the X-ray exposure and (directly or indirectly) detect the X-ray absorption resulting from the X-irradiation in the object under investigation, wherein this detection takes place with the aid of the measuring unit of the X-ray source.

c) To control the exposure of the image as a function of the detected X-ray absorption of the object under investigation by adjusting the tube current of the X-ray tube within a predetermined current range, wherein, furthermore, a second exposure parameter is adjusted if the tube current is set to one of the two limit values of the current range and therefore the predetermined exposure target cannot be achieved by a further adjustment of the tube current.

The X-ray source described has the advantage that it maintains the parameters of exposure duration and tube voltage specified by the user, which are particularly important for the image quality and the observance of limit values, constant for as long as possible in that, firstly, control of the exposure through adjustment of the tube current is attempted. Only if the technically specified limits are reached hereby is recourse had to a second exposure parameter.

The second exposure parameter may be the exposure duration of the X-ray image. This is then adjusted by the control system within a predetermined time slot in order to achieve the exposure target if the tube current is already set to its minimum value or its maximum value. If the predetermined exposure target cannot be met even when the exposure duration is set to the upper or lower limit of the time slot, a third exposure parameter is adjusted by the control system, whilst the tube current and the exposure duration each assume their limit value. Application examples in which the predetermined exposure duration has a high priority may be covered in this context by an extremely narrow time slot (of zero width in the extreme case).

The above-mentioned third exposure parameter is preferably the tube voltage, which is adjusted by the control system within a predetermined voltage range in order to achieve the exposure target. If the tube voltage is set to the upper or lower limit of the voltage range without the exposure target being achieved as a result, a fourth exposure parameter is preferably adjusted by the control system in order to achieve the exposure target.

The above-mentioned fourth exposure parameter may be the exposure duration. The exposure duration is thereby preferably adjusted twice in different status areas of the control system: the first time when an adjustment of the tube current was insufficient, and the second time when, in addition, a first adjustment of the exposure duration in the predetermined time slot and an adjustment of the tube voltage were insufficient. In this case, the exposure duration is adjusted in the area outside the predetermined time slot. Although the departure from the time slot hereby leads to an impairment of the image quality through the suboptimal exposure duration, the overriding exposure target can be ensured. When the exposure duration is adjusted outside the time slot, it is generally ensured that predetermined acceptability limits of the exposure duration are not exceeded, since this would lead to, for instance, an excessively long exposure duration for the patient and/or the X-ray apparatus.

The exposure target pursued by adjustment of the tube current or of the further exposure parameters preferably consists in achieving an image with a predetermined optimum radiation dose (time integral of the dose rate over the exposure duration).

In accordance with a preferred embodiment of the X-ray source, its X-ray tube is equipped with a control grid, which is arranged in front of the anode and to which a voltage counter to the anode can be applied. The current of the electrons traveling from the heating filament to the anode may be controlled in intensity or completely interrupted by the counter-voltage at the control grid. The advantage of controlling the tube current in this way lies in the fact that very fast reaction times in the microsecond range can be achieved, which are not achievable in this way by adjustment of the heating current. An X-ray tube with control grid is therefore suited in a particular manner for a system of control where the adjustment of the tube current takes place first and foremost. Further details on the use of a control grid are described in DE 101 36 947 A1, the contents of which are included in the present application by virtue of reference.

For control of an X-ray tube with control grid, the control system is preferably equipped with a heating-current controller for activating the heating filament, and a grid controller for activating the control grid. The heating-current controller sets a base value for the heating current, which preferably remains constant during the X-ray exposure and which determines the maximum tube current. By applying a counter-voltage to the control grid, the grid controller can reduce the maximum tube current, in a controlled manner, to a desired effective tube current. At the start of an X-ray exposure, the heating-current controller and grid controller preferably set base values that enable the grid controller subsequently both to increase and to reduce the tube current.

The above-mentioned grid controller is preferably set up to control the pulse width of a pulsed counter-voltage at the control grid. With a pulsed counter-voltage at the control grid, a tube current pulsing between a maximum value and zero may be generated, wherein the pulse width of the counter-voltage, or its scanning ratio, determines the mean value of the tube current.

The invention further relates to an X-ray system comprising at least one device for image generation and image processing, and an X-ray source of the type explained above. With the X-ray source, X-radiation is generated, which radiates through an object under investigation, such as a patient, and is then received by the device for image generation and image processing, and converted into an X-ray image.

Furthermore, the invention relates to a method for the exposure control of X-ray images, which comprises the following steps:

a) Presetting predetermined start values for the tube voltage and tube current of the X-ray tube;

b) Starting an X-ray exposure and (direct or indirect) detection of the resultant X-ray absorption of the object under investigation;

c) Controlling the exposure of the image as a function of the detected X-ray absorption of the object under investigation by adjustment of the tube current within a predetermined current range and by adjustment of a second exposure parameter if the tube current is set to one of the limit values of the current range.

With this method, the advantages described above in relation to the X-ray source can be achieved. In addition, the method may be further developed generally through the steps that may optionally be executed by the control system of the X-ray source, in accordance with the above explanatory information.

The invention will be further described with reference to examples of embodiments shown in the drawings, to which, however, the invention is not restricted.

The image quality of digital and non-digital medical X-ray images depends significantly on the correct preselection of the following significant exposure parameters: tube voltage U (kV), tube current I (mA) and exposure duration t (ms) by the equipment operator. It is typically a prerequisite hereby that the appropriate, optimum parameters for every image generation problem, every patient and every position are known. In clinical practice, however, the situations occurring and the X-ray transparencies of the patients may vary over a range corresponding to a factor of more than 3600. Equally, the abilities and clinical experience of the equipment operators are, of course, very different. Typically, therefore, between 10% and 30% of all X-ray images have to be repeated owing to defective quality.

Figure 1:
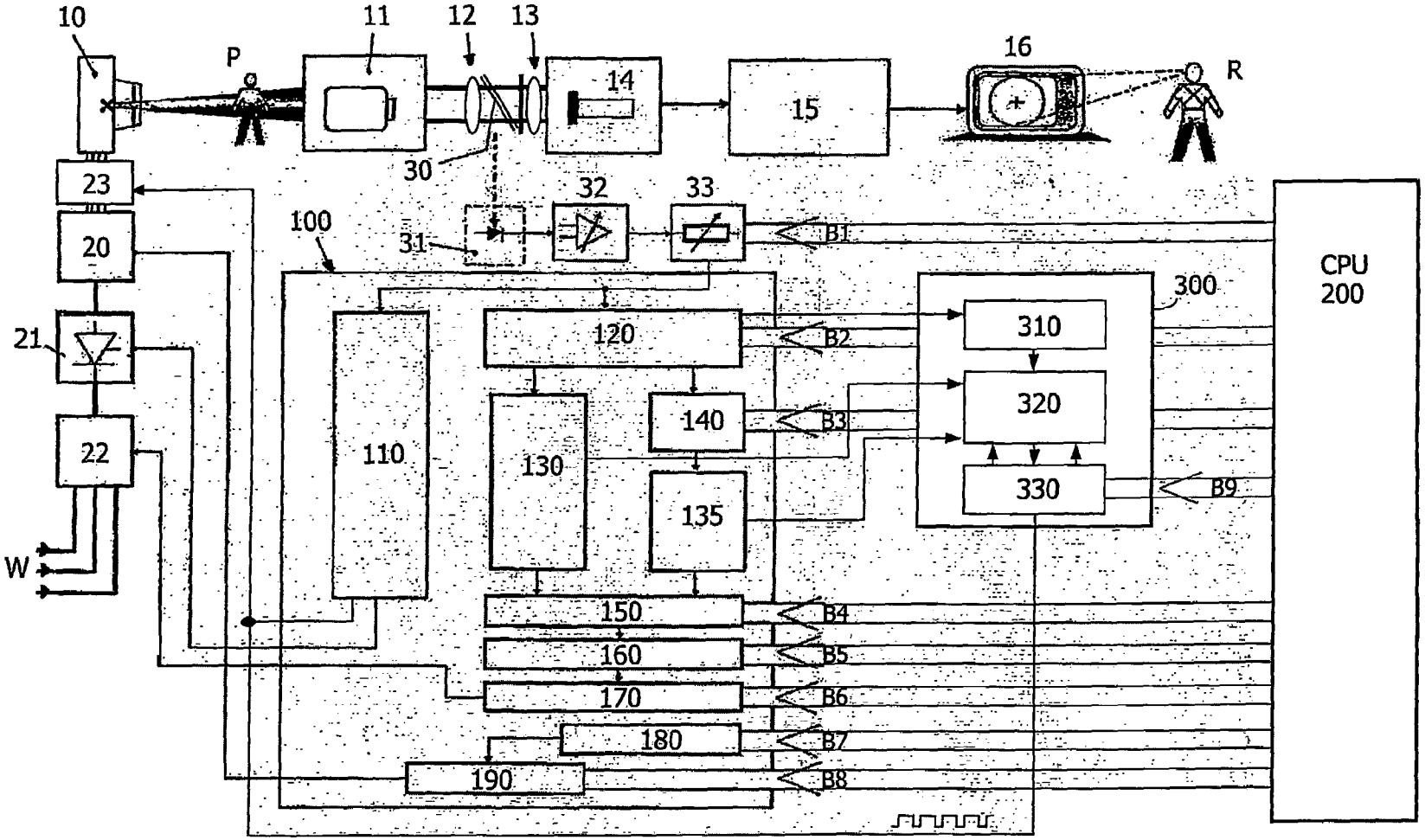
FIG. 1 shows a schematic diagram of an X-ray system with an X-ray source in accordance with the invention.

In order to overcome this problem, an automatic exposure control is proposed, ensuring an optimum adjustment of the tube current I, the tube voltage U and the exposure duration t, and simultaneously leaving the user's probably intended stipulation of the (investigation object-dependent) X-ray voltage and the maximum exposure duration unchanged for as long as technically possible. In this manner, the best diagnostic image quality can be achieved for a given investigation object and a given product from the tube current and exposure duration (mAs). This aim is achieved with an X-ray system as shown in FIG. 1, which represents an expansion of the X-ray system disclosed in DE 101 22 041 A1 (corresponding to US 2002/0191741 A1). By virtue of reference, these previously mentioned documents are included in full in the present application.

As shown in FIG. 1, among the most important components of an X-ray system is an X-ray tube 10 for generating X-rays which permeate a patient P and project a replica of the area under investigation onto an image intensifier 11. This replica is amplified in a known manner and converted into light signals, which are then focused by a lens and aperture arrangement 12, 13, recorded by a camera 14, and converted into corresponding electrical signals. These signals are sent to an image processing device 15, which is generally digital, to which a monitor 16 is connected for the observance of the area of patient P under investigation by a radiologist R.

The X-ray tube 10 is supplied by a high-voltage generator 20. Via a circuit breaker 21 for switching the high voltage on and off, the high-voltage generator 20 is connected to a converter 22, which serves for the conversion of a general mains voltage W into an appropriate input voltage for the high-voltage generator 20, and thereby determines the exposure kV voltage value (i.e. the high voltage present at the X-ray tube).

Further shown in FIG. 1 is a unit 23 for controlling the counter-voltage at a control grid of the, X-ray tube 10. The flow of electrons from the heating filament to the anode of the X-ray tube 10—i.e. the tube current—can be dynamically controlled via the counter-voltage, preferably pulsed, present here.

The exposure parameters are influenced and/or adjusted as follows with the components described: The exposure duration t (time to produce the image) and the radiation dose to which the patient is subjected can be adjusted by appropriate activation of the circuit breaker 21 with a first control signal. The dose rate of the X-ray tube 10 is adjusted by activation of the converter 22 and thereby by adjustment of the exposure kV voltage with a second control signal. In addition, the heating current of the X-ray tube 10 can be adjusted with a third control signal, which is present at a corresponding input of the high-voltage generator 20. These three control signals are generated with a multi-variable controller 100, which is controlled with a microprocessor unit 200 via a plurality of bus lines B2 to B8.

The X-ray system is further equipped with a grid controller 300, the output of which is coupled to the control unit 23 of the control grid. The output signal of the grid controller 300 controls the pulse width of the counter-voltage at the control grid, and thereby controls the effective tube current in the X-ray tube 10.

In order to generate a controlled variable for the multi-variable controller 100 in the form of a dose or dose rate impinging in the area of the camera 14, which is determined by the X-ray absorption of the patient P and other image-influencing objects, a radiation divider 30, with which a partial beam is extracted from the X-radiation and directed onto a corresponding sensor 31 (photosensor) for generation of a dose or dose-rate signal, is arranged on the camera 14. The photosensor 31 is connected to a calibrator 32, with which a voltage normalized to this dose or dose rate is generated. This voltage is present at a divider 33, with which a nominal value of the dose (e.g. 0.66 μGy) or dose rate (e.g. 66 μGy/s) can be set. To this end, the divider is connected via a first bus B1 to the microprocessor unit 200. The output signal of the divider 33 is present at the multi-variable controller 100.

The multi-variable controller 100 contains a dose regulator 110 (Amplimat), which is known per se, to which the output signal of the divider 33 is sent and which is equipped with an integrator for this signal and a comparator. The dose regulator generates the first control signal for the circuit breaker 21 and regulates the exposure time for producing the image as a function of the dose measured at the photosensor 31 and of the nominal dose value set via the divider 33.

Further, a nominal-time selector 120 for a range from e.g. approximately 4 to 4000 ms is provided, which also receives the output signal of the divider 33 and which can be activated by the microprocessor unit 200 via the second bus B2 for setting the nominal value for an upper limit $T_{max}$ of an exposure time slot or of a maximum exposure time (e.g. 50 ms).

The nominal-time selector 120 is connected via a first output to a first dose-rate regulator 130 and via a second output to a unit 140 for generating a time-slot factor of, for instance, between 1 and 10 (realized as an attenuator with a factor between 1 and 0.1), with which, from the selected maximum exposure time $T_{max}$, a nominal value for a lower limit $T_{min}$ of the exposure time slot or of a minimum exposure time (e.g. 10 ms) is generated. The factor is determined in accordance with the minimum exposure time $T_{min}$, inputted via the microprocessor unit 200 and the third bus B3. The output of the unit 140 is present at the input of a second dose-rate regulator 135.

The first dose-rate regulator 130 essentially comprises a PID controller with a mean speed in the order of approximately 5 kHz, and serves only for positive corrections, i.e. for upward control (an increase) in the exposure kV voltage for the X-ray tube. The second dose-rate regulator 135 essentially comprises a PID controller with a high speed in the order of approximately 10 kHz and serves exclusively for negative corrections, i.e. for downward control (a reduction) in the exposure kV voltage.

The outputs of the two dose-rate regulators 130, 135 are supplied to a first limiter 150, wherein the limiter is activated by the microprocessor unit 200 via the fourth bus B4, and serves for setting the limit values up to which, as a maximum, the exposure kV voltage may be increased or reduced with the dose-rate regulators (e.g. by +25 kV or +15 kV, or by −15 kV or −10 kV respectively in relation to the starting value).

The nominal value of an exposure kV start voltage is adjustable via the microprocessor unit 200 and the fifth bus B5. When investigating humans, this nominal value is generally the organ kV voltage of the organ under investigation (e.g. 70 kV). To this end, the fifth bus B5 is supplied to a signal mixer 160, which is connected to the output of the first limiter 150, and serves to generate the exposure kV voltage by summation of its set starting value with the voltage values generated by the dose-rate regulator.

Further, a second limiter 170 is provided for the exposure kV voltage arrived at by summation by the signal mixer 160, with which second limiter a permitted overall range of this voltage of e.g. between 55 and 125 kV can be set via the microprocessor unit 200 and the sixth bus B6. The second limiter 170 generates at its output the second control signal, which is finally supplied to the converter 22 in order that the general mains voltage W may be converted in such a way that the corresponding exposure kV voltage value can be generated by the high-voltage generator 20.

The multi-variable controller 100 further comprises a unit 180 for generating a tube-current factor as a function of a selected image intensification format, wherein a desired current factor can be inputted by means of the microprocessor unit 200 via the seventh bus B7, and lies between e.g. 1 and 2.5.

Finally, the output of the unit 180 is connected to a unit 190 for generating a nominal value for the heating current as a function of a base value (e.g. 200 mA), which can be set via the microprocessor unit 200 and the eighth bus B8, and of the tube-current factor determined by the unit 180. The output of the unit 190, which generates the third control signal, is supplied to the high-voltage generator 20 and controls it in such a way that the determined nominal value of the heating current is generated.

The grid controller 300 is equipped with a first block 310, which receives the measured current dose rate in signal form from the nominal-time selector 120. Further, the first block 310 receives information concerning the minimum value $T_{min}$ and the maximum value $T_{max}$ of the predetermined time slot and the optimum value to of the exposure duration (typically the midpoint of the time slot).

In a priority regulator 320 with four areas, a rapid regulation of the dose rate takes place, with e.g. a PID controller, by means of adjustment of the tube current. The priority regulator 320 hereby takes account of whether or not the first dose-rate regulator 130 or the second dose-rate regulator 135 is active. On the output side, the regulator 320 controls a pulse-width control module 330, the output of which in turn undertakes the described activation of the pulse width of the counter-voltage at the control grid. The pulse-width control module 330 receives required parameters from the microprocessor 200 via a bus B9. It further signals to the regulator 320 whether a limit position (minimum or maximum pulse width) has been reached.

The operation of the X-ray system shown in FIG. 1 is further explained below. The control method on which it is based may hereby be executed equally well with recording media such as BV/TV, digital instantaneous-imaging technology (DSI), digital flat detectors, memory foils (PCR systems) or conventional film or foil systems. It fulfills equally the application-specific requirements for the most precise organ kV value possible and for a desired exposure duration by means of automatic control, taking place directly within approximately 1 ms of the start of an X-ray exposure. The exposure quality (radiation dose) fluctuates in all dynamic exposure situations, i.e. when generating X-ray sequences, by less than 3%. With a constant kV value of the tube voltage, the dose-rate regulation takes place only via the tube current and/or the exposure duration. This is particularly important for subtraction angiography, in which an identical tube voltage should be present in order to achieve comparable representations in the images to be subtracted. The above-mentioned properties are achieved with an X-ray system as shown in FIG. 1 by the very rapid controlling of the tube current I within less than 100 μs and a higher-order priority-regulation concept with a very high operating speed, which is ensured by a high-speed analog regulator.

The rapid controlling of the tube current hereby takes place in two stages, firstly by regulation of the heating current and secondly by regulation of the grid voltage in the grid-controlled X-ray tube 10. Before the exposure of an image starts, a cathode heating current is set, which is maintained at a constant level throughout the duration of exposure. The mean value of the tube current can be adjusted very rapidly (<100 μs) in a desired manner via pulse-width modulation during the exposure. The heating current thereby selects the maximum value of the tube current, and the grid controller 300 enables the rapid adjustment of the effective tube current to required mA values during the exposure. This will be further explained below with reference to a numerical example. The grid controller 300 is to be capable of adjusting only part of the range of the tube current. Typically, a range of 1:10 (or 10% to 100%) is fully adequate in this regard, which corresponds to e.g. a tube current between 33 mA and 330 mA. A minimum value of 10 mA should be implemented as the absolute limit in the grid controller 300. The maximum value of 330 mA is determined by the heating filament control (heating current). At the start of an X-ray exposure, the grid controller 300 sets a pulse width of the counter-voltage at the control grid 23 such that a tube current of 100 mA results. The grid controller 300 then has, up to the said maximum value of 330 mA, a control margin with a factor of (+) 3.3, and, up to the said minimum value of 33 mA, a control margin with a factor of (−) 3. Following the start of an exposure and the presence of a dose-rate error signal, the grid controller 300 can, within less than 100 μs, adjust the tube current in such a way that the required dose rate, referred to the object being X-rayed, is set.

Figure 2:
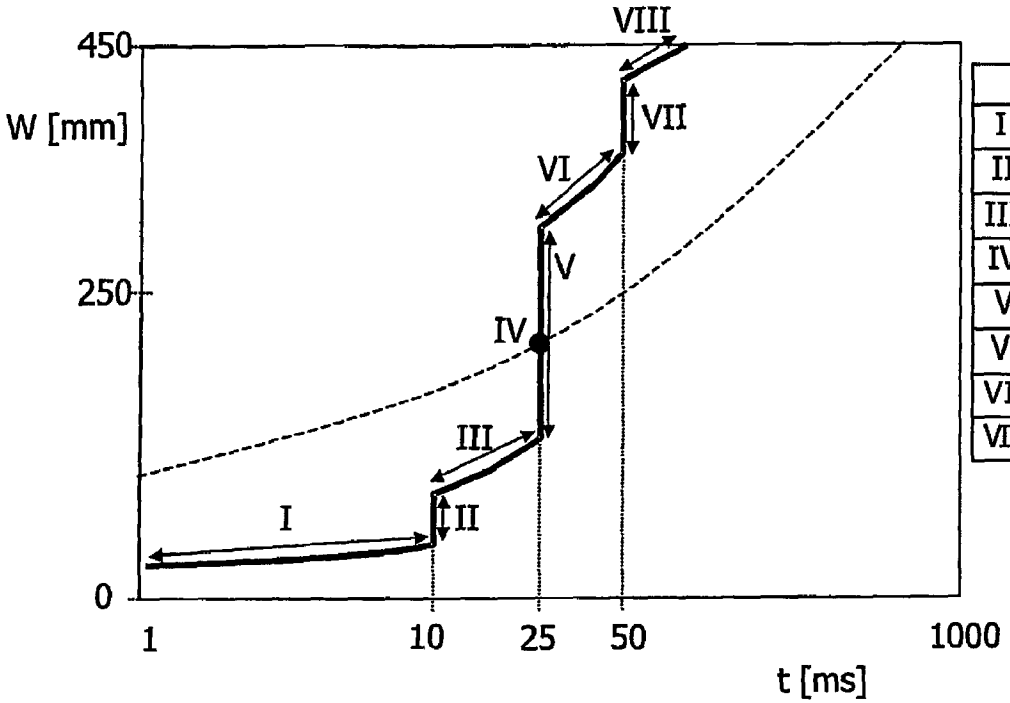
FIG. 2 shows a diagram of the exposure duration as a function of the object density.

The above-described rapid controlling of the tube current is combined, in a higher-order control concept, with the controlling of the exposure duration t and the tube voltage U, which takes place in the multi-variable controller 100, as will be described in greater detail below with reference to FIG. 2. FIG. 2 shows, in a diagram, the connection between the set exposure duration t (horizontal axis) and the object density (X-radiation absorption) expressed by the water equivalent value W (vertical axis), wherein further image-influencing elements of the object density that increase absorption are to be added for the following explanation. The unbroken line drawn in the diagram represents the characteristic of the exposure duration t set by the control system, as a function of the object density W, wherein the exposure duration t and the tube current I and the tube voltage U are set in such a way that a predetermined dose is achieved for each X-ray image. In a numerical example considered below, let the dose per image be e.g. 0.66 μGy and the dose rate of the X-ray source between 13.2 μGy/s and 26.4 μGy/s. Furthermore, let the exposure duration t preferably lie within a time slot between a minimum exposure duration $T_{min}$=10 ms and a maximum exposure duration $T_{max}$=50 ms.

At the start of an X-ray exposure, the starting values desired for the application: $t_0$=25 ms for the exposure time t, $I_0$ for the tube current I and $U_0$ for the tube voltage U are set. This corresponds to point IV in the diagram in FIG. 2, wherein an anticipated object density W also needs to be assumed. Following the start of the exposure, the control system checks at great speed (<100 μs) the level of the dose-rate signal. The reaction depends on the results of the check, and is as follows:

1) If the measured dose rate indicates that the desired image dose is not achieved with the current exposure parameters (i.e. the actual object density differs from expectations), the tube current I is firstly increased or reduced by the grid controller 300 (area V in FIG. 2). As soon as the desired dose rate is achieved, it is used to complete the X-ray image. The exposure duration is then $t=t_0$=25 ms, as desired.

2) If the desired dose rate is not achieved despite the setting of a maximum tube current $I_{max}$, the next step is for the exposure duration t to be increased in area VI up to the predetermined maximum value $T_{max}$. In a corresponding manner, the exposure duration t is reduced in area III to the minimum value $T_{min}$ if the tube current $I_{min}$ that can be set as a minimum still does not yield the desired dose rate. An adjustment to the exposure duration t within the time slot [$T_{min}$, $T_{max}$] takes place in the multi-variable controller 100 of FIG. 1. This adjustment to the exposure time t may be skipped if adherence to a predetermined exposure time $t_0$ has priority. Formally, this case may be covered in the context of the present example by $T_{min}=T_{max}$. If, conversely, the value of an organ kV has priority, the adjustment as described of exposure duration t must take place.

3) In areas II and VII respectively of FIG. 2, the tube current I and the exposure duration t are at their lower limits $I_{min}$, $T_{min}$ and their upper limits $I_{max}$, $T_{max}$ respectively. If the required dose rate is still not achieved in this state, the tube voltage U is reduced or increased by the multi-variable controller 100, starting from its starting value $U_0$, in the voltage range [$U_{min}$, $U_{max}$].

4) If the setting of the tube voltage U reaches its lower limit $U_{min}$ or its upper limit $U_{max}$ without the desired dose rate being achieved, a further adjustment of the exposure duration t takes place. In area I of FIG. 2, it is shortened below the lower limit $T_{min}$, and in area VIII it is lengthened above the upper limit $T_{max}$. In the case of this shortening or lengthening, it is generally ensured that predetermined absolute limits for exposure duration t are adhered to even if the desired dose rate would require a further adjustment of the exposure duration.

With the described control method, a decision is thereby made at the start of an X-ray exposure as to which parameters are to be adjusted in which order. The first parameter to be adjusted is always the tube current I, since it keeps the contrast-scaling constant of the object under investigation stable. The rapid adjustment of the tube current I is achieved via a pulse-width modulation at the control grid. The next step is the (optional) adjustment of the exposure duration t within a time slot, and subsequently the adjustment of the tube voltage U within a voltage range. If the X-ray density of the object under investigation is then still too high or too low, the exposure duration t may be adjusted until the desired dose is achieved. In this manner, a constancy of the exposure doses of ±3% can be guaranteed, even in extremely dynamic exposure situations. By virtue of the achievable image quality, this technology is particularly suitable for (subtraction) angiography.

The invention claimed is:

1. An X-ray source, comprising:

an X-ray tube for generating X-rays, the spectrum and intensity of which depend on the tube voltage and the tube current;

a measuring unit for detecting the X-ray absorption resulting from the activity of the X-ray source;

a control system, coupled to the X-ray tube and the measuring unit, to control the tube current, the tube voltage and the exposure duration of the X-ray tube, wherein the control system is set up to perform the following steps:

a) To preset predetermined start values for the tube voltage and tube current of the X-ray tube;

b) To start the X-ray exposure and detect the resultant X-ray absorption;

c) To control the exposure of the image by adjusting the tube current within a predetermined current range and adjusting at least one exposure parameter if the tube current is set to one of the two limit values of the current range, wherein at least one exposure parameter is the exposure duration, which is adjusted within a predetermined time slot, and wherein at least one other exposure parameter is adjusted if the exposure duration is set to one of the limits of the time slot.

2. An X-ray source as claimed in claim 1, wherein at lest one exposure parameter is the tube voltage, which is adjusted within a predetermined voltage range, wherein at least one other exposure parameter is adjusted if the tube voltage is set to one of the limits of the voltage range.

3. An X-ray source as claimed in claim 2, wherein the at least one other exposure parameter is the exposure duration.

4. An X-ray source as claimed in claim 1, wherein the exposure of the image is controlled in such a way that a predetermined radiation dose is achieved.

5. An X-ray source as claimed in claim 1, wherein the X-ray tube is equipped with a control grid in front of the anode, to which a counter voltage can be applied in order to control the tube current.

6. An X-ray source as claimed in claim 5, wherein the control system is equipped with a heating-current controller for setting the heating current of the X-ray tube, and a grid controller for activating the control grid.

7. An X-ray source as claimed in claim 6, wherein the grid controller is set up to control the pulse width of a pulsed counter-voltage at the control grid.

8. An X-ray system comprising at least one device for image generation and image processing, and an X-ray source as claimed in claim 1.

9. A method for the exposure control of X-ray images, which comprises the following steps:

a) Presetting predetermined start values for the tube voltage and tube current of the X-ray tube;

b) Starting an X-ray exposure and detection of the resultant X-ray absorption;

c) Controlling the exposure of the image by adjustment of the tube current within a predetermined current range and by adjustment of at least one exposure parameter if the tube current is set to one of the limit values of the current range, wherein at least one exposure parameter is the exposure duration, which is adjusted within a predetermined time slot, and wherein at least one other exposure parameter is adjusted if the exposure duration is set to one of the limits of the time slot.

* * * * *